US005568826A

United States Patent [19]

Vogel et al.

[11] Patent Number: 5,568,826

[45] Date of Patent: Oct. 29, 1996

[54] PILE WARP DISPENSING IN ADVANCE OF BEAT-UP IN A TERRY LOOM

[75] Inventors: Rudolf Vogel, Grüt; Klaus Berktold, Rüti, both of Switzerland; Husnu Evren, Erenköy/Istanbul, Turkey

[73] Assignee: Sulzer Rueti AG, Rueti, Switzerland

[21] Appl. No.: 437,094

[22] Filed: May 5, 1995

[30] Foreign Application Priority Data

May 10, 1994 [EP] European Pat. Off. ..... 94810279

[51] Int. Cl.[6] ..... D03D 39/22

[52] U.S. Cl. ..... 139/25; 139/102

[58] Field of Search ..... 139/25, 102, 105

[56] References Cited

U.S. PATENT DOCUMENTS

| | | | |
|---|---|---|---|
| 4,721,134 | 1/1988 | Dorman et al. | 139/25 |
| 4,827,985 | 5/1989 | Sugita et al. | 139/25 |
| 4,884,597 | 12/1989 | Tamura et al. | 139/25 X |
| 5,002,095 | 3/1991 | Herrin et al. | 139/25 |
| 5,029,616 | 7/1991 | Deconnick | 139/25 |
| 5,069,257 | 12/1991 | Borisch | 139/105 |

FOREIGN PATENT DOCUMENTS

| | | |
|---|---|---|
| 0257857 | 3/1988 | European Pat. Off. . |
| 0518809 | 12/1992 | European Pat. Off. . |
| WO91/05895 | 5/1991 | WIPO . |

OTHER PUBLICATIONS

Patent Abstracts of Japan, vol. 14, No. 578 (C–0791) Dec. 21, 1990 & JP–a–02 251 639 (Nissan Motor Co. Ldt., Abstract.

*Primary Examiner*—Andy Falik
*Attorney, Agent, or Firm*—Townsend and Townsend and Crew

[57] ABSTRACT

Terry cloth is woven by determining the pile warp yarn consumption during partial and full beat-ups of the pile warp on the basis of reference pattern data established for the terry cloth that is to be woven and which is used to control the payout of pile warp several picks in advance of the pick when a given length of pile warp yarn is actually needed. A feed-back arrangement compares the required length of pile warp for any given beat-up with the length of pile warp actually paid out and makes adjustments to the pile warp payout mechanism to compensate for any differences between them. As the length of pile warp yarn between a supply thereof and the fell in the weaving machine varies, due to differences between the instantaneous rates of yarn payout and consumption and/or other factors, a compensating roller in engagement with the pile warp yarn keeps its tension constant to assure the weaving of correctly sized terry loops.

13 Claims, 2 Drawing Sheets

PILE WARP DISPENSING IN ADVANCE OF BEAT-UP IN A TERRY LOOM

BACKGROUND OF THE INVENTION

The present invention relates to a process for controlling the sequence of motion of the pile warp let-off, wherein the pile warp tension is maintained constant by means of a feed-back controller. The present invention further relates to a terry weaving machine for performing the process.

SUMMARY OF THE INVENTION

It is therefore an object of the invention to provide a process of the initially named kind with which the length of pile warp yarn required for loop formation is made available several picks before it is needed while maintaining the tension of the pile warp constant.

This is attained in accordance with the invention by paying out metered amounts of pile warp yarn several picks ahead of the pick when a given, needed length of the yarn will be partially or completely beat-up during terry weaving. A feed-back arrangement compares the needed amount of pile warp for a given pick with that actually paid out from a supply of such yarn and makes the necessary adjustments to compensate for any differences between the two. Further, the pile warp tension is maintained constant irrespective of differences between the consumption of the pile warp during weaving and the controlled payout of the yarn several picks before it is needed. This assures that undesirable variations in the terry loop sizes, which can result from variations in the pile warp tension, are prevented, so that blemish-free terry cloth can be woven.

BRIEF DESCRIPTION OF THE DRAWINGS

The invention is described in the following by means of example only and with reference to the following figures.

DESCRIPTION OF THE PREFERRED EMBODIMENTS

Figure 1:
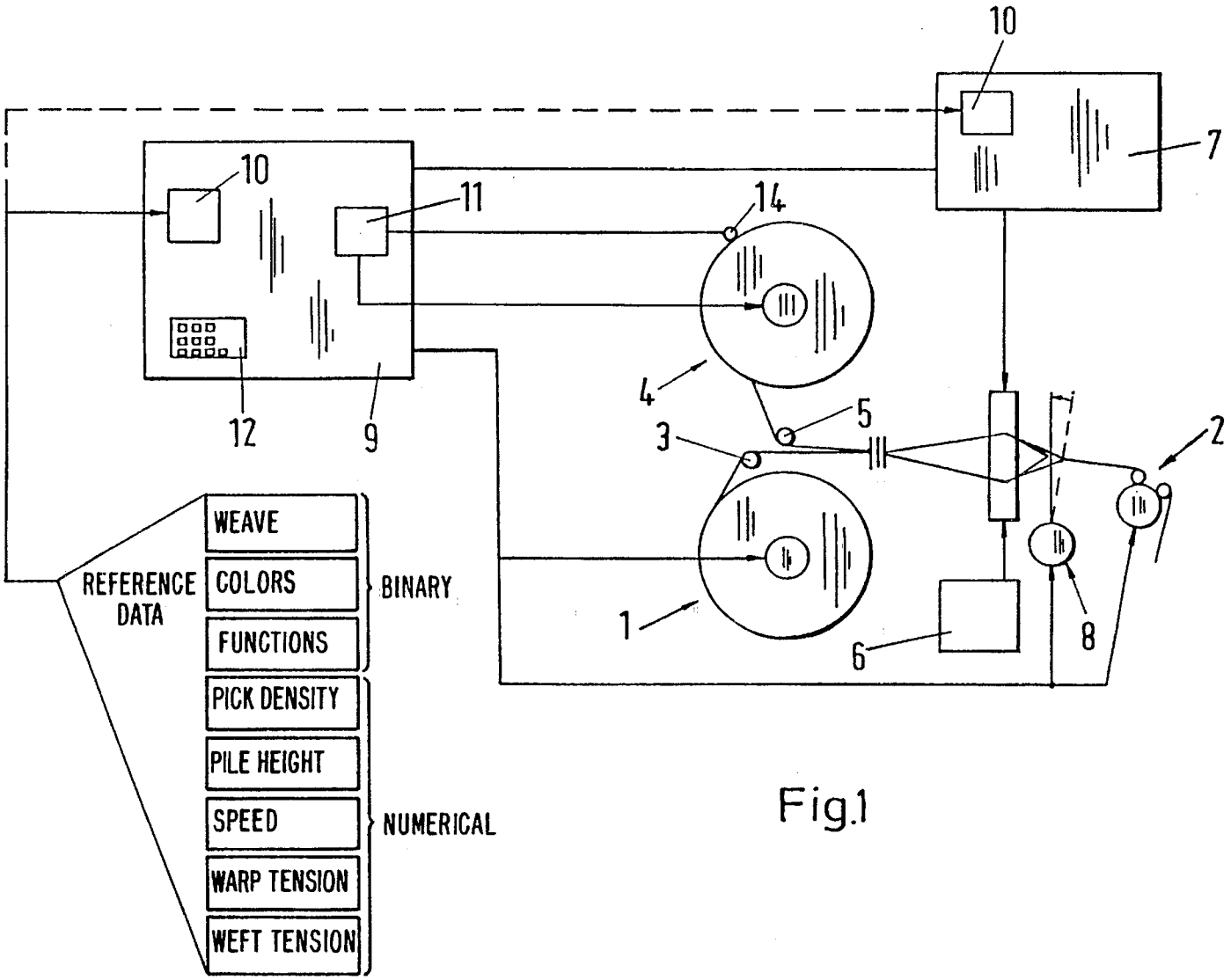
FIG. 1 is a block diagram of a terry weaving machine for performing the process and FIG. 2 is a schematic representation of an embodiment of a process of the invention.

As is known, terry weaving takes place with a tense ground warp and a looser pile warp. For the ground warp the warp tension is produced by coordinating the sequence of motion of the warp let-off device 1 and the fabric take-off device 2 and a warp tensioning system 3. For the pile warp, the warp tension is produced by coordinating the sequence of motion of the pile warp let-off device 4 and a pile warp compensating roller 5.

Terry weaving takes place with the aid of programmable reference pattern data relating to the weave, color, functions, pick density, machine speed, weft yarn tension, warp yarn tension and pile height, this data being stored in the jacquard device 7 or the control device 9. The reference pattern data for the weave, colors and functions are stored in a binary form. The reference pattern data for the pick density, machine speed, warp tension, weft yarn tension and pile height are stored in numerical form. It is noted that the entire reference pattern data can be stored in numerical form. The weaving machine shown in FIG. 1 weaves according to the principle of sley control (i.e. control via the sweep of the sley) wherein the beat distances are stored in the reference pattern data "pile height". It is noted that the process can also be used in weaving machines which weave according to the principle of cloth control.

For the formation of each loop in terry weaving a particular length of pile warp yarn is required which is wound off or drawn off the pile warp let-off device.

An embodiment of the terry weaving machine shown in FIG. 1 can be used for this. In addition to the devices already mentioned, this weaving machine comprises a shedding apparatus having a dobby 6 or a jacquard device 7, as well as a controller 8 for the sweep of the sley. These devices are controlled by means of a control device 9. The control device 9 or the jacquard device 7 comprises a control means 10 in which the reference pattern data are stored in binary and/or numerical form. The control device 9 further comprises a feed-back device 11 for the sequence of motion of the pile warp let-off and also a control unit 12 with a key pad for influencing the control of the machine. The control of the weaving machine is described in the following only insofar as required for an understanding of the process discussed here.

Figure 2:
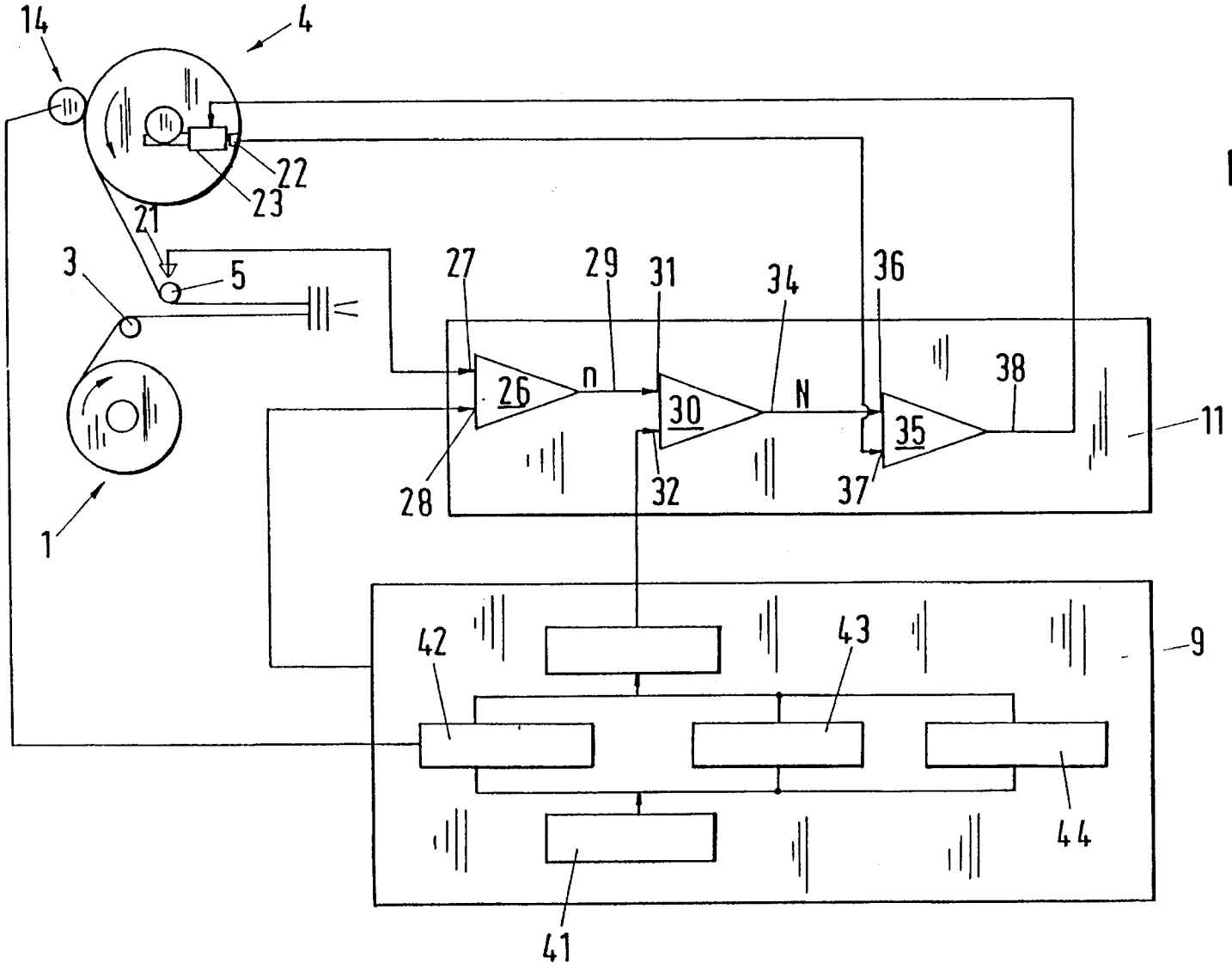

The feed-back control apparatus shown in FIG. 2 comprises a sensor 21 which is arranged in the region of the pile compensating roller 5, a sensor 22 which measures the rotational speed of the pile warp let-off device 4, a device 23 to adjust the rotational speed of the pile warp let-off device and a measurement arrangement 14 to determine the drawn-off length of pile warp yarn. The feed-back control apparatus further comprises an arrangement consisting of a first feed-back controller 26 having a first input 27 which is electrically connected to the sensor 21, a second input 28 which is connected to a reference value output device, and an output 29, a second feed-back controller 30 having a first input 31 which is connected to the output 29 of the first feed-back controller 26, a second input 32 which is connected to the control device 9, and an output 34, as well as a third feed-back controller 35 having a first input 36 which is connected to the output 34 of the second feed-back controller 30, a second input 37 which is connected to the speed sensor 22, and an output 38 which is connected to the speed adjustment device 23.

For terry weaving a ground warp and a pile warp are required. The tension of the ground warp is held constant via the coordination of the sequence of motion of the warp let-off device 1 having an electronically controlled drive and the fabric take-off device 2 having an electronically controlled drive. The tension of the pile warp is maintained constant via a control loop 11, the pile compensating roller 5 for sensing the actual value, and an electronically controlled drive of the pile warp let-off device which acts as a regulation member. The consumption of pile warp yarn is determined primarily from the reference pattern data 41 for the pile height. Consequently, the process discussed here is described on the basis of the reference pattern data "pile height" which is used as the reference value for the feed-back control.

In a first step 42, the reference value of the pile height is related to the beat distances required for the pile formation for the type of terry being woven. In so doing, a reference pile length is determined for each pick. This determination his carried out in advance, i.e. at a point in time occurring for a particular number of picks (e.g. five picks) prior to the actual insertion of the relevant pick. The size and nature of the advance can be freely chosen.

Due to the dynamic behavior of the pile formation members, as well as due to the conditions defined by technical weaving factors (e.g. nature of the yarn, weave etc.), a changed warp tension of the pile warp manifests itself. In a second step 43, which is performed simultaneously, this difference is compensated with the aid of a parameter in which the value of the parameter is calculated pick-for-pick as a particular function of the reference pile length.

A predetermined value for the warp yarn length required for the loop formation is determined from these two steps.

A step 44 is performed, either as an extra step for quicker optimization of the feed-back control, or also instead of the second step 43, in which the length of the pile warp yarn drawn off or stripped from the pile warp beam is measured. A deviation between the reference pile length and the actual pile length is either taken into account by the parameter from step 43 or is included into the value of the reference pile length by means of the additional parameter "length measurement".

The value determined in the two or three steps is included in the feed-back control as follows.

A value variable which represents the position of the pile compensating roller 5 or the warp tension of the pile warp as well as the base speed of the pile warp let-off device needed for maintaining the pile warp tension is produced by a reference/actual comparison via the first feed-back controller 26 and is applied to the first input of the second feed-back controller 30. The predetermined value for the loop to be woven which was calculated in advance is included as the second input of the second feed-back controller 30 so that the value represents the speed of the warp let-off device needed for making available the length of pile warp yarn required for loop formation. This value forms a guide size for the third feed-back controller 35 which, via a reference/actual comparison, regulates the speed predetermined by the guide size.

As already mentioned, terry weaving takes place with the aid of programmable reference pattern data. The reference pattern data can be stored and changed with the aid of the control unit in order to optimize the course of the process and consequently also the terry weaving.

The reference pattern data, which is stored after the so-called patterning, forms the basis for the production of a cloth. The reference pattern data is stored in the control device and, as a rule, has to be changed to correspond to the warp yarn, pile warp yarn and weft yarn being used in order to provide optimum production conditions. These changes are made with the aid of different individual parameters. As an example the role of the parameters and their effect is explained with reference to the cloth requirement "towel weight".

For determining the weight, the proportions of ground warp, weft yarn and pile warp are the main parameters to be taken into account. A change in the weight is most easily achieved by the incorporation of pile warp and specifically via changing the loop height.

The following description relates to 3-pick terry cloth in which each pick group comprises a first and a second partial beat and a full beat. In the present case, only the third pick is beaten up to the full. Groups of picks to be beaten home are formed in this way which are disposed separated from the fell by a distance corresponding to the desired loop height. In so doing, the first pick and the second pick are each displaced by a respective partial beat to a distance from the fell which is termed as the pre-beat distance.

In the process described here, this pre-beat distance can be predetermined either via manual input from the key pad 12 (FIG. 1) or via the reference pattern data which can either be stored in the shedding apparatus and/or in the control device and can be calculated in the control device on the basis of predetermined cloth parameters. The terry cloth calculated according to these parameters has a corresponding theoretical towel weight. In order to produce terry cloth with a predetermined cloth weight, parameters are used in the process of the invention in order to change the pre-beat distance and to match the towel weight to the consequent changes in the loop height.

Two possibilities are chosen for this. On the one hand, the pre-beat distance for all the partial picks is corrected by the parameter value and, on the other hand, the pre-beat distance for the first pre-beat pick is reduced according to a parameter. With the second possibility, the loop formation can be influenced in a particularly advantageous manner.

A further feature of the invention is that an influence can be exerted on the type of terry cloth by either changing, or optionally fixing, the type of terry cloth stored in the reference pattern data.

In the process of the invention, the sequence of motion of the warp let-off is controlled with feed-back by determining the consumption of the pile warp yarn in advance on the basis of programmable reference pattern data and is used for modulating the manipulated variable of a feed-back controller.

A weaving machine is provided with a control device 9 for this which is connected to the feed-back device 11 so as to be able to transfer signals in order to modulate the manipulated variable. The towel weight of the cloth can thus be maintained and/or changed.

What is claimed is:

1. A method for weaving terry cloth with alternating partial and full beat-ups of a pile warp yarn against a terry cloth fell to thereby form pile warp yarn loops comprising the steps of determining a desired length of pile warp yarn required for each pile warp yarn beat-up against a fell; dispensing from a pile warp yarn supply a desired length of pile warp yarn for a given pile warp yarn beat-up in advance of the given beat-up; maintaining constant tension in at least a portion of the pile warp yarn between the fell and the pile warp yarn supply; sensing a difference between the desired length of pile warp yarn to an actual length of pile warp yarn dispensed for the given beat-up; and compensating for any sensed difference by adjusting the dispensing step so that the desired pile warp yarn is dispensed for the given beat-up and made available for terry weaving a plurality of beat-ups prior to the given beat-up while tension in the pile warp yarn upstream of the fell is maintained constant.

2. A method for controlling the supply of pile warp yarn during weaving of a terry cloth to thereby control the formation of terry loops, the method comprising the steps of establishing a reference pattern data for the terry cloth which includes data defining a length of pile warp yarn required for each beat-up; dispensing the required length of pile warp yarn for each beat-up a plurality of beat-ups prior to the beat-up when the required length of pile warp yarn will be beat-up; sensing an actual length of each dispensed required length of pile warp yarn; with a feed-back control arrangement comparing the sensed actual length of the required pile warp yarn with the required pile warp yarn length and, in response to detecting a difference between them, adjusting the rate with which the pile warp yarn is dispensed to thereby compensate for the difference; and maintaining a tension in the dispensed pile warp yarn constant until it is beat-up irrespective of changes in at least one of the sensed pile warp length and the required pile warp length.

3. A process according to claim 2 including the step of changing the reference pattern data.

4. A method according to claim 2 wherein the step of dispensing comprises varying the lengths of dispensed pile warp yarn for partial beat-ups and full beat-ups performed during terry weaving.

5. A method according to claim 2 including the step of varying the predetermined number of beat-ups.

6. A method of weaving a terry cloth on a weaving machine by successively performing a plurality of partial pile warp yarn beat-ups followed by a full pile warp yarn beat-up to thereby form loops on the terry cloth with the pile warp yarn and control sizes of the loops, the method comprising the steps of providing a reference pattern data for the terry cloth which establishes a required length of pile warp yarn for each partial and full pile warp yarn beat-up; successively dispensing from a supply of pile warp yarn the required lengths of pile warp yarn for the partial and full beat-ups a plurality of beat-ups in advance of the beat-up when a given required length of pile warp yarn is to be beat-up; comparing the lengths of dispensed pile warp yarn with corresponding lengths of pile warp yarn established by the reference pattern data and adjusting the dispensing step to compensate for any difference between them; and maintaining substantially constant tension in the pile warp yarn dispensed from the supply and until it is beat-up irrespective of differences between the length of pile warp yarn being consumed during a given beat-up step and the length of pile warp yarn dispensed from the supply; whereby the occurrence of undesirable differences in terry loop lengths are prevented and loop sizes can be intentionally varied.

7. A weaving machine for weaving terry cloth having terry loops formed by pile warp yarn, the weaving machine comprising a pile warp yarn let-off device for supplying pile warp yarn for successive pile warp yarn beat-ups; a control device including reference pattern data which defines the manner of weaving the terry cloth to therewith control the formation of the terry loops; means for dispensing the pile warp yarn for use during weaving the terry cloth; a feed-back arrangement operatively coupled with the control device and the dispensing means for dispensing pile warp yarn in accordance with the reference pattern data so that an amount of pile warp yarn needed for a given beat-up is dispensed from the supply several beat-ups in advance of the given beat-up, the feed-back arrangement including means for compensating differences between the amount of pile warp yarn needed for a given one of the beat-ups and the amount of pile warp yarn actually dispensed therefor; and a compensating roller engaging the pile warp yarn dispensed from the supply for maintaining constant tension in the pile warp yarn irrespective of differences between the amount of pile warp yarn consumed by each beat-up and the amount of pile warp yarn dispensed from the supply thereof.

8. A weaving machine according to claim 7 wherein the control device includes a control unit having input means for inputting the reference pattern data in the control means.

9. A weaving machine according to claim 8 wherein the input means includes means for changing the reference pattern data in the control device.

10. A weaving machine according to claim 7 including means operatively associated with the let-off device and the feed-back arrangement for measuring the length of pile warp yarn dispensed by the let-off device.

11. A weaving machine according to claim 7 including a shedding apparatus formed as one of a dobby and a jacquard device, and wherein the reference pattern data is stored in one of the control device and the jacquard device.

12. A weaving machine according to claim 7 including a shedding apparatus formed as one of a dobby and a jacquard device, and including storage means operatively associated with one of the control device and the shedding apparatus for storing the reference pattern data in at least one of numerical and binary form.

13. A weaving machine according to claim 7 wherein the control device comprises a computer-supported control unit for calculating and storing specific cloth data with the reference pattern data and further weaving parameters for controlling the operation of the weaving machine.

* * * * *